US005782181A

United States Patent [19]

Rossini

[11] Patent Number: 5,782,181

[45] Date of Patent: Jul. 21, 1998

[54] CONCENTRIC DOUBLE SLEEVE FOR A ROTARY PRINTING CYLINDER

[75] Inventor: Felice Rossini, Milan, Italy

[73] Assignee: Erminio Rossini S.p.A., Milan, Italy

[21] Appl. No.: 613,895

[22] Filed: Mar. 11, 1996

[30] Foreign Application Priority Data

Mar. 14, 1995 [IT] Italy ..... MI95A0489

[51] Int. Cl.[6] ..... B41F 9/06

[52] U.S. Cl. ..... 101/153; 101/375

[58] Field of Search ..... 101/375, 216, 101/153

[56] References Cited

U.S. PATENT DOCUMENTS

| | | | |
|---|---|---|---|
| 2,365,980 | 12/1944 | Thomas . | |
| 3,015,268 | 1/1962 | Garrett . | |
| 3,043,211 | 7/1962 | Appenzeller . | |
| 3,146,709 | 9/1964 | Bass et al. . | |
| 3,475,803 | 11/1969 | Hill . | |
| 3,673,025 | 6/1972 | Fukuyama et al. . | |
| 3,959,574 | 5/1976 | Seanor et al. . | |
| 3,978,254 | 8/1976 | Hoexter et al. . | |
| 4,030,415 | 6/1977 | Fellows . | |
| 4,044,678 | 8/1977 | Rasmussen . | |
| 4,089,265 | 5/1978 | White et al. | 101/375 |
| 4,119,032 | 10/1978 | Hollis . | |
| 4,144,812 | 3/1979 | Julian . | |
| 4,144,813 | 3/1979 | Julian . | |
| 4,296,172 | 10/1981 | Hill . | |
| 4,381,709 | 5/1983 | Katz . | |
| 4,496,434 | 1/1985 | Morssinkhof . | |
| 4,503,769 | 3/1985 | Andersen . | |
| 4,554,040 | 11/1985 | van der Velden . | |
| 4,583,460 | 4/1986 | Maslin et al. | 101/375 |
| 4,641,411 | 2/1987 | Meulen | 101/375 |
| 4,794,858 | 1/1989 | Katz . | |
| 4,903,597 | 2/1990 | Hoage et al. . | |
| 5,206,992 | 5/1993 | Carlson et al. . | |
| 5,316,798 | 5/1994 | Tittgemeyer . | |
| 5,468,568 | 11/1995 | Kuhn et al. | 101/375 |
| 5,544,584 | 8/1996 | Thompson et al. | 101/375 |

FOREIGN PATENT DOCUMENTS

| | | |
|---|---|---|
| 278017A1 | 8/1988 | European Pat. Off. . |
| 384104B1 | 9/1994 | European Pat. Off. . |
| 623466A3 | 11/1994 | European Pat. Off. . |
| A1229548 | 12/1966 | Germany . |
| 8532300 U | 2/1986 | Germany . |
| A3525045 | 1/1987 | Germany . |
| 1188238 | of 1988 | Italy . |
| 57-107845 | 7/1982 | Japan . |

OTHER PUBLICATIONS

Werbeprospekt der Einsprechenden zur Messe "PacPro '88" vom 05.–11.05.1988 in Dusseldorf, Seite 1 und Seite 12 (trade journal).

Papier & Kunststoff Verarbeiter, vol. 23, No. 9, Sep. 1988, Frankfurt DE, pp. 40 42 44 XP002006545 E. Schulz: "Nahtlose Fotopolymer–Druckwalzen nach dem Hulsenprinzip".

Zeitschrift "druck print Dec. 1987" Seite 20 bis 22 (trade journal).

(List continued on next page.)

*Primary Examiner*—Edgar S. Burr
*Assistant Examiner*—Daniel J. Colilla
*Attorney, Agent, or Firm*—Dority & Manning

[57] ABSTRACT

An inner sleeve portion in the form of a spacer sleeve is disclosed for being torsionally rigidly mounted on a rotogravure or flexographic mandrel that is to be rotated about its axis when used in a printing machine. The outer surface of the inner sleeve portion torsionally rigidly supports by an interference fit, an outer sleeve portion (the printing sleeve) that carries the printing matrices. The inner sleeve portion has a plurality of air channels extending from the inner surface through the outer surface. Pressurized air flowing through the channels assists in expanding the diameter of the innermost surface of the outer sleeve portion for alternatively mounting the outer sleeve portion onto the inner sleeve portion and dismounting the outer sleeve portion from the inner sleeve portion.

12 Claims, 3 Drawing Sheets

OTHER PUBLICATIONS

Zeitschrift "EFM/Sep. 1987", Seite 22 bis 24 (trade journal).
Patent Abstracts of Japan, vol. 6, No. 201 (M-163), 13 Oct. 1982 & JP-A-57 107842 (Dainippon Printing Co. Ltd.).
Nouvelles Graphiques, vol. 38, No. 18, Oct. 1988, Deurne BE. pp. 20 24 25 XP002006546 A. Vermeire: "Stork Revolutionne La Serigraphie avec ses manchons La trame Himesh".

CONCENTRIC DOUBLE SLEEVE FOR A ROTARY PRINTING CYLINDER

This invention relates to a rotary printing cylinder in accordance with the introduction to the main claim.

A printing cylinder for rotogravure or flexography is known to comprise a generally steel mandrel on which a sleeve is mounted. This latter carries the printing elements (recessed or in relief). The sleeve is generally of tubular cylindrical form and can be mounted on the mandrel by various known methods, involving for example surface deformation of the mandrel or the use of air to facilitate the mounting of the sleeve on the mandrel. The sleeve is of small thickness to allow it to be easily handled.

The use of the aforesaid known cylinders has however various drawbacks deriving in particular from their use for different print developments. In this respect, when the print development changes the cylinder diameter must be changed. As the sleeves, as stated, are of small thickness, the diameter change is necessarily achieved by replacing the sleeve. In other words, the change in print development is achieved by replacing the mandrel with one of the desired diameter and mounting an appropriate sleeve on it. This operation is however difficult to carry out because of the weight of such mandrels (which as stated are of steel), and involves considerable cost.

An object of the present invention is to provide a sleeve for rotary printing cylinders which enables the print development to be changed quickly at low cost.

A further object is to provide a sleeve of the aforesaid type which is easy to handle.

These and further objects which will be apparent to the expert of the art are attained by a sleeve for a rotary printing cylinder in accordance with the accompanying claims.

The present invention will be more apparent from the accompanying drawing, which is provided by way of non-limiting example and in which.

Figure 1:
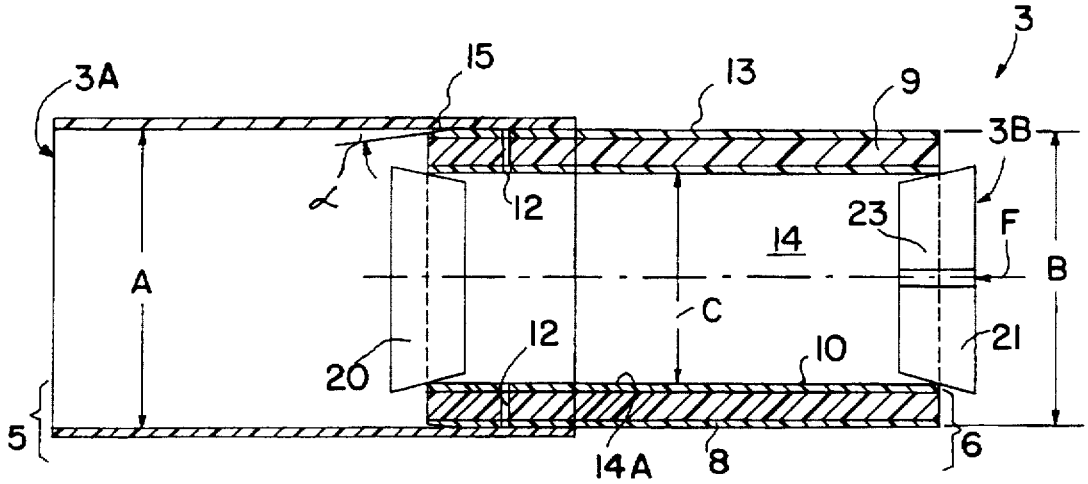
FIG. 1 is a longitudinal section through a sleeve according to the invention taken during its assembly.
Figure 2:
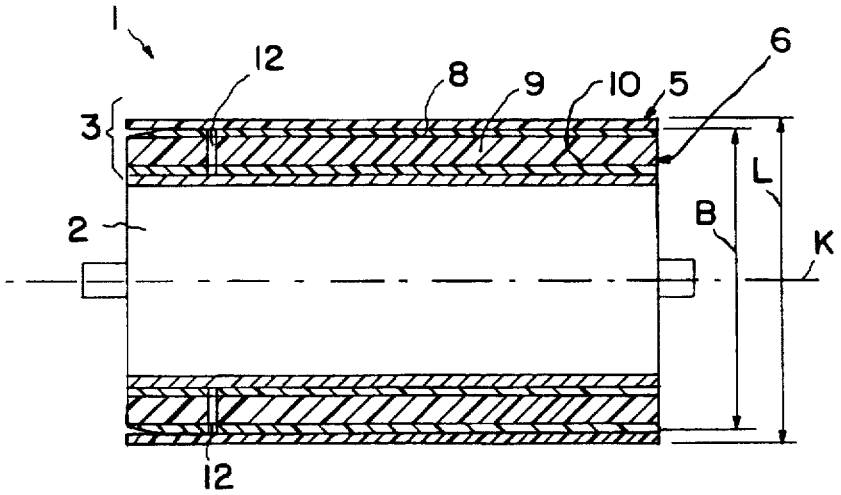
FIG. 2 shows a printing cylinder provided with the sleeve of the invention.

With reference to said figures, a printing cylinder is indicated overall by 1 and comprises a mandrel 2 on which a sleeve 3 open at its two ends 3A, 3B is mounted. The mandrel, generally of steel, is arranged to rotate about its axis K driven in any known manner. According to the invention the sleeve 3 comprises two cylindrical portions 5 and 6, the portion 5 (the outer) being mounted about the portion 6 (the inner) and being arranged to support the printing matrices if these are not already an integral part of said portion 5. Said portions 5 and 6 are both cylindrical and tubular to enable them to be fitted together and to be mounted on the mandrel.

Specifically, the outer sleeve portion 5 is of very small thickness and is constructed for example of glass fibre and epoxy resin. In contrast in the illustrated embodiment the sleeve portion 6 consists of three concentric cylindrical layers 8, 9 and 10, the layers 8 and 10 (outer and inner) being of high rigidity material such as carbon fibre, and the intermediate layer being of expanded rigid polyurethane. Alternatively, said portions can be of other constituent materials (for example the material known as aramid fibre sold under the trademark KEVLAR, or hardened glass or carbon fibre bonded by epoxy or polyester resins by known methods), said materials being in any event known.

In the portion 6 there are provided at one of the open ends 3A, 3B of the sleeve 3 a plurality of channels 12 opening into the outer surface 13 of this portion and communicating with the inner cavity 14 of the sleeve 3. These channels (of diameter for example between 1.5 and 3 mm) are arranged to feed compressed air from the interior of the sleeve 3 to said surface 13 to enable the portion 5 to be fixed onto and released from the portion 6. To facilitate the mounting of the portion 5 onto the inner portion, this latter has a surface part 15 close to the end 3A inclined (for example by an angle alpha-α-of between 12° and 20°) to the remaining surface 13. This hence provides a lead-in for mounting the portion 5 onto the portion 6.

It will now be assumed that a sleeve 3 according to the invention is to be assembled; for example it will be assumed that a previously used print character supported by a first portion 5 is to be changed to a different character supported by a different portion 5. To release the components of the sleeve 3, it is firstly separated from the mandrel 2, after which its ends 3A, 3B are closed by usual closure elements (such as frusto-conical plugs 20 and 21), one of which is provided with a through channel 23. These plugs seal against the wall 14A of the inner cavity 14 of the sleeve.

Compressed air (at a pressure of up to 12 bar) is then fed into the cavity 14 through the channel 23 (arrow F in FIG. 1). This air penetrates into the channels 12 and reaches the surface 13 on which the portion 5 is located. The air pressure does not change the diameter (inner or outer) of the portion 6 because of the rigidity (and considerable thickness relative to that of the portion 5) of the layers 8, 9 and 10. The portion 5 has an inner diameter A very close to the outer diameter B of the portion 6 and is coupled to this latter by an interference fit. This fit is such as to make the two portions act as one, so that the sleeve 3 behaves as though it were in one piece from the torsional stress viewpoint. In other words, during the rotation of the cylinder 1, the portions 5 and 6 undergo no relative slippage, neither is there any relative slippage (deriving from torsional forces) between the portion 6 and the mandrel 2.

On feeding air onto the surface 13, the portion 5 becomes detached (by virtue of its own elasticity) from the portion 6. The portion 5 can hence be withdrawn from the portion 6 by maintaining the air feed into the channels 12.

To mount a new portion 5 onto the portion 6 the procedure is analogous to that carried out for the aforesaid withdrawal. Furthermore the lead-in present on the surface 13 of the portion 6 facilitates the mounting of the portion 5 onto this latter. This mounting is hence done while maintaining the compressed air feed into the cavity 14 and hence into the channels 12, said air on reaching the surface 13 causing a slight elastic expansion of the portion 5, enabling the said mounting to be achieved. When mounting is complete, air feed into the sleeve 3 is interrupted on which, by elastic return, the portion 5 becomes coupled to the portion 6 as an interference fit. As stated, this fit is such as to prevent relative slippage between said portions.

The sleeve 3 formed in this manner, being extremely lightweight because of its constituent materials, can be mounted on the mandrel 2 to obtain a printing cylinder of the required development (ie with a required diameter L). If said development is to be changed, the sleeve 3 is withdrawn from the mandrel 2 and a new sleeve is used having its portion 6 of a different diameter B but with its inner diameter C equal to that of the withdrawn sleeve. A corresponding portion 5 is fitted to the portion 6.

This substitution can be achieved quickly and at low cost in that a set of different diameter portions 5 and 6 costs considerably less than a corresponding set of different diameter mandrels (which in any event would require the use of sleeves also of different inner and outer diameters). Consequently, the print development can be changed using the same mandrel and replacing only the sleeve. This operation is facilitated by the low sleeve weight.

The portion 5 separated from the portion 6 withdrawn from the mandrel 2 can be stored for subsequent repetitive printing.

Figure 3:
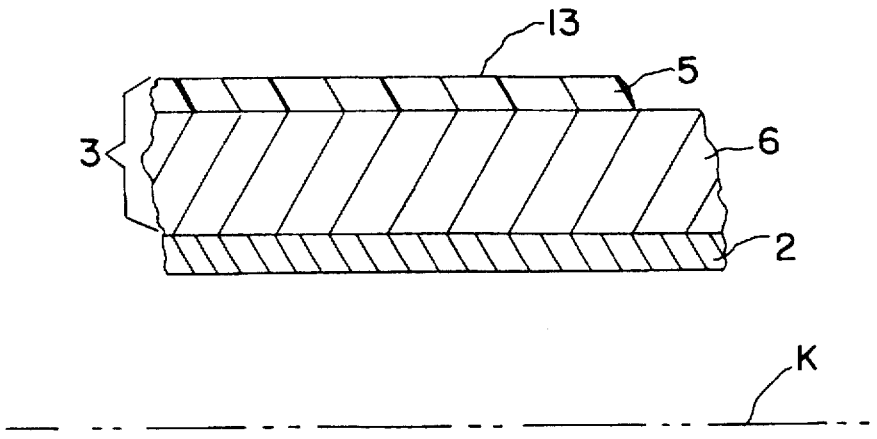
FIG. 3 shows an enlarged partial longitudinal section through an alternative embodiment of the inner sleeve portion mounted on a printing cylinder.
Figure 4:
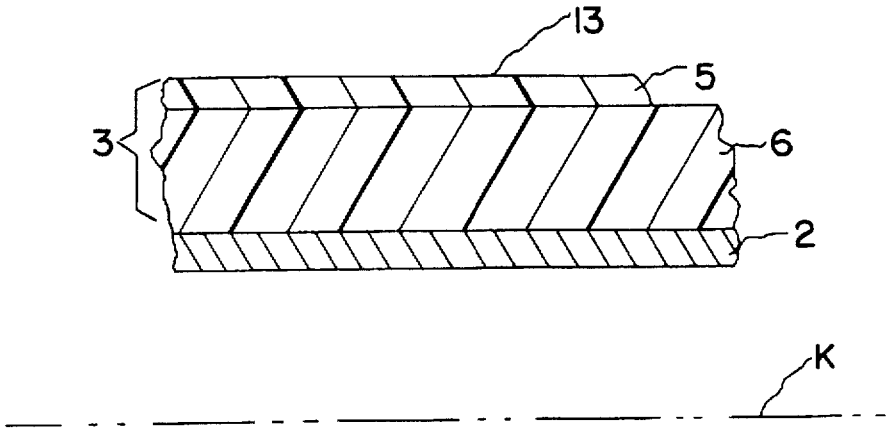
FIG. 4 shows an enlarged partial longitudinal section through another alternative embodiment of the inner sleeve portion mounted on a printing cylinder.
Figure 5:
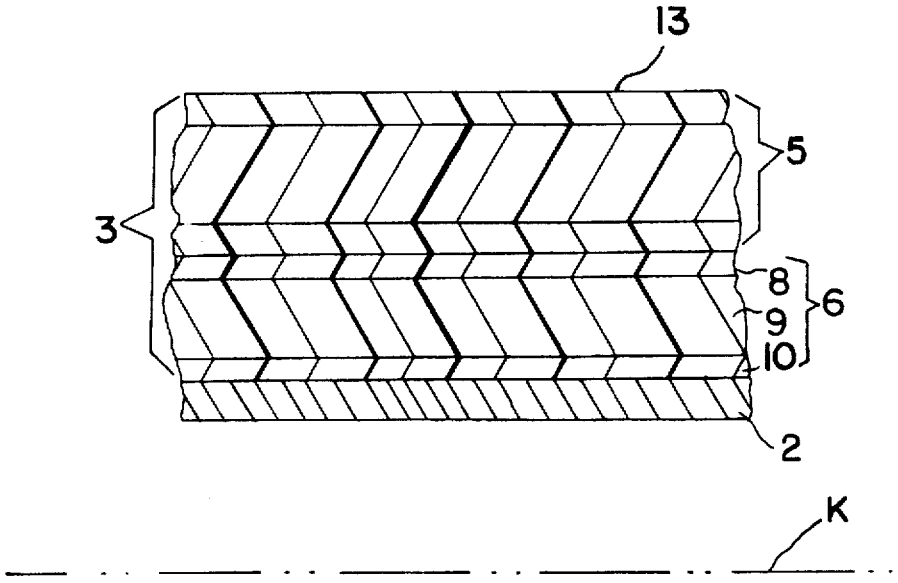
FIG. 5 shows an enlarged partial longitudinal section through an alternative embodiment of an outer sleeve portion mounted on an embodiment of the inner sleeve portion, which is mounted on a printing cylinder.

One particular embodiment of the invention has been described. Other embodiments can however be provided in which the, portion 6 can be of a single layer rather than of several layers as described. The portion 6 in particular can also be of metal (aluminium, titanium and their alloys or steel) as shown in FIG. 3 for example or of rigid plastics (rigid PVC, ABS etc.) as shown in FIG. 4 for example, and the portion 5 applied to this latter can also be of a different material from that described, and could be multi-layered as shown in FIG. 5 for example. Likewise, a preferred method of coupling together the two portions defining the sleeve 3 (using compressed air) has been described. However the portions 5 and 6 can be coupled together in a torsionally rigid manner in any other known manner.

Hence these embodiments also fall within the scope of the present document.

I claim:

1. An inner sleeve portion for use in the combination of a rotogravure or flexographic mandrel said inner sleeve portion, and an outer sleeve portion that is to be rotated about its axis when used in a printing machine, an inner sleeve portion to be mounted on the mandrel, the inner sleeve portion comprising:

an inner cylindrical layer formed of high rigidity material and defining an inner surface and an outer surface;

an outer cylindrical layer formed of high rigidity material and defining an inner surface and an outer surface;

an intermediate cylindrical layer having an inner surface disposed against said outer surface of said inner layer, and said intermediate layer having an outer surface disposed against said inner surface of said outer layer; and a plurality of channels, each said channel being configured to feed air from said inner surface of said inner layer through said outer surface of said outer layer.

2. An inner sleeve portion as in claim 1, wherein said intermediate layer is formed of expanded polyurethane.

3. An inner sleeve portion as in claim 1, wherein said intermediate layer is formed of expanded rigid polyurethane.

4. An inner sleeve portion as in claim 1, wherein said high rigidity material is selected from the group consisting of aramid fibre, hardened glass fibre bonded with epoxy resin, hardened glass fibre bonded with polyester resin, carbon fibre bonded with epoxy resin, and carbon fiber bonded with polyester resin.

5. An inner sleeve portion as in claim 1, wherein said outer layer defines a first free end and said channels are disposed in proximity to said first free end.

6. An inner sleeve portion as in claim 5, wherein said outer surface of said outer layer has a surface part disposed from said first free end and toward said channels, said surface part being inclined to the rest of said outer surface of said outer layer so as to form a lead-in for mounting the outer sleeve portion onto said outer surface of said outer layer.

7. An inner sleeve portion as claimed in claim 1, wherein said inner surface of said inner layer defines a constant inner diameter.

8. An inner sleeve portion as in claim 1, wherein said inner layer, said intermediate layer and said outer layer are a unitary structure composed of a high rigidity material selected from the group consisting of titanium, titanium alloy, aluminum, aluminum alloy, steel, PVC, and ABS.

9. An apparatus for use in combination with a rotogravure or flexography mandrel that is to be rotated about its axis when used in a printing machine, the apparatus comprising:

an inner cylindrical layer formed of high rigidity material and defining an inner surface and an outer surface;

an outer cylindrical layer formed of high rigidity material and defining an inner surface and an outer surface;

an intermediate layer having an inner surface disposed against said outer surface of said inner layer, and said intermediate layer having an outer surface disposed against said inner surface of said outer layer;

a plurality of channels, each said channel being configured to feed air from said inner surface of said inner layer through said outer surface of said outer layer; and an outer sleeve portion having a radially expandable innermost surface for mounting the outer sleeve portion on said outer surface of said outer layer via an interference fit between said outer surface of said outer layer and said radially expandable innermost surface of said outer sleeve portion.

10. An inner sleeve portion as in claim 9, wherein said intermediate layer is formed of expanded polyurethane.

11. An inner sleeve portion as in claim 9, wherein said intermediate layer is formed of expanded rigid polyurethane.

12. An apparatus as in claim 9, wherein said printing sleeve is multi-layered.

* * * * *